United States Patent [19]

Janhonen

[11] Patent Number: 4,674,129

[45] Date of Patent: Jun. 16, 1987

[54] PACKAGING BAG WITH SELECTIVELY SECURED REINFORCING LAYER

[76] Inventor: Veikko I. Janhonen, Långvik, 02420 Jorvas, Finland

[21] Appl. No.: 846,277

[22] Filed: Mar. 31, 1986

Related U.S. Application Data

[63] Continuation of Ser. No. 609,985, May 14, 1984, abandoned.

[51] Int. Cl.[4] ..... B65D 33/02

[52] U.S. Cl. ..... 383/119; 229/68 R; 229/92; 383/107; 383/109

[58] Field of Search ..... 383/109, 119, 122, 107, 383/88, 84, 105, 114; 229/68 R, 75, 76, 92

[56] References Cited

U.S. PATENT DOCUMENTS

| | | | |
|---|---|---|---|
| 159,029 | 1/1875 | Grinter | 383/122 |
| 846,899 | 3/1907 | Berold, Jr. | 383/122 X |
| 936,588 | 10/1909 | Vierengel | 383/122 X |
| 943,126 | 12/1909 | Sofge | 383/122 X |
| 955,564 | 4/1910 | Vierengel | 383/122 X |
| 1,160,280 | 11/1915 | Greve | 229/76 |
| 1,187,317 | 6/1916 | Holmes | 229/76 |
| 1,545,290 | 7/1925 | Taylor | 150/52 F |
| 1,549,832 | 8/1925 | Hartmann | 293/220 |
| 1,744,285 | 1/1930 | Taylor | 383/122 X |
| 1,821,246 | 1/1931 | Taylor | 383/122 |
| 2,092,602 | 7/1937 | Finn et al. | 383/109 X |
| 2,246,911 | 6/1941 | Baker | 383/114 X |
| 2,330,015 | 9/1941 | Stokes | 383/119 X |
| 2,350,132 | 5/1944 | Rohdin | 383/109 X |
| 4,325,507 | 4/1982 | Janhonen | 383/109 X |

*Primary Examiner*—William Price
*Assistant Examiner*—Bryon Gehman
*Attorney, Agent, or Firm*—Price, Heneveld, Cooper, DeWitt & Litton

[57] ABSTRACT

The specification discloses a multi-layer reinforced envelope including inner and outer sheets of thin flexible material and an intermediate sheet of reinforcing material. All of the sheets are elongated and folded along a line substantially mid-way between the ends of the sheets to define first and second portions of each sheet. The intermediate sheet is secured to only one of the inner and outer sheets and to only one of the first and second portions of that sheet.

8 Claims, 7 Drawing Figures

PACKAGING BAG WITH SELECTIVELY SECURED REINFORCING LAYER

This is a continuation of application Ser. No. 609,985, filed May 14, 1984, now abandoned.

The present invention relates to a packaging bag of a type defined in the preamble of claim 1 as well as to a method set out in the preamble of claim 1 for the fabrication of a packaging bag.

This type of a multi-layer packaging bag, fitted with a reinforcement board, and a method for its fabrication are known in the prior art from the Applicant's earlier Finnish Patent publication No. 59229. In that publication, the inner layer of a bag comprises a sheet of cardboard as reinforcement and the outer layer is made of paper whose edge flaps extend beyond the side edges of said sheet of cardboard, said flaps being usable for sealing the side edges of a bag after double-folding a package blank in V-shape fashion. Because single-layer paper is not sufficiently strong for sealing the side edge but may tear open during packing, two paper flaps are bent around both side edges. However, one of the paper flaps must then be necessarily passed in between the cardboard sheet and outer paper. Performing this automatically in a fabricating machine has proved difficult, the mechanism becoming complicated and expensive with high production rates unattainable.

An object of the invention is to further develop such a packaging bag so as to facilitate its fabrication with a method that can be effected by using a simple apparatus and at a high rate of production.

This object will be accomplished by means of a packaging bag of the invention by providing it with the characterizing features set out in claim 1.

The fabrication method is characterized by what is set forth in claim 5.

The invention will be described in more detail in the following specification with reference made to the accompanying drawings, in which FIG. 1 is a perspective view of the superimposed layers of a package blank of the invention, the layers being shown apart from each other for the sake of clarity.

FIG. 3 is a side view of the superimposed layers of a package blank.

The following specification deals with a fabrication method of the invention whereby the end product will be a final package design. Three separate supply rollers are used to deliver three different material webs. At first, the material webs are apart from each other but still on top of each other, i.e. their center axes lie in a common vertical plane. The lowermost, widest web 1 is paper. Also the uppermost web 3 is paper and it is narrower than the bottom web 1. The intermediate web 2 is made of rather stiff cardboard and it is the narrowest layer.

Figure 2:
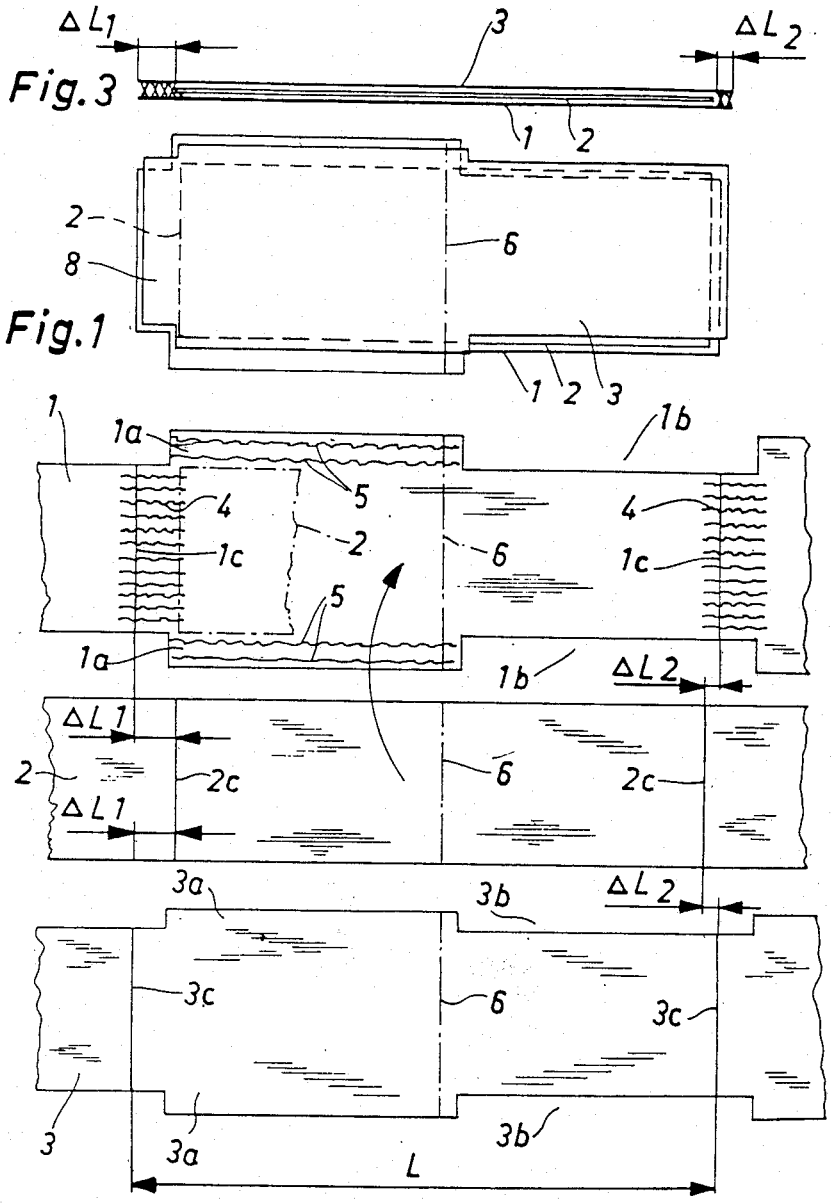
FIG. 2 shows each layer of a package separately, at the same time illustrating the widths, side edge cut-outs, gluing points, cut-off points and bending points of various layers.

FIG. 2 show that the side edges of the top and bottom web are cut off to provide lengthwise cut-outs 1*b* and 3*b* extending on either side of propective cut-off points 1*c* and 3*c*. Cut-outs 1*b* and 3*b* are made in a manner that all material webs 1, 2 and 3 are of the same width thereat.

Thereafter, on the bottom layer is applied an adhesive 4 on either side of prospective cut-off points 1*c*. Adhesive 4 extends on one side of cut-off point 1*c* substantially further than on the other side. The reason for this will be explained hereinbelow. The cardboard web 2 is cut along cut-off lines 2*c* which are so positioned relative to prospective paper web cut-off lines 1*c* and 3*c* that at one end said cardboard 2 is a distance ΔL1 shorter and at the other end a distance ΔL2 shorter than paper layers 1 and 3. The cut-off cardboard sheets 2 are so placed on top of the bottom paper layer 1 that one end sticks on adhesive 4 on that side of prospective cut-off point 1*c* where adhesive 4 extends further. This has been illustrated in FIG. 2 by showing the end of cardboard sheet 2 with dot-and-dash lines on top of said layer 1. The other end of cardboard sheet 2 does not extend on adhesive zone 4 so that, in the bending step effected later around a central bending line 6, the layers will be freely settled relative to each other.

This is followed by the application of an adhesive 5 on the edge flaps 1*a* of bottom layer 1. Top layer 3 is run on top of said bottom layer 1 in a manner that edge flaps 3*a* come on top of edge flaps 1*a* and cut-outs 1*b* and 3*b* will be in register. Thus, the edge flaps 1*a* and 3*a* of layers 1 and 3 as well as sections extending beyond the ends of cardboard sheet 2 adhere to each other. Thereafter, said cardboard sheet 2 remains stuck between paper layers 1 and 3.

In the following step, said face-to-face glued paper layers 1 and 3 are cut off along cut-off lines 1*c* and 3*c* which meet the edge cut-outs 1*b* abd 3*b* and at the same time said adhesive zones 4.

Obtained this way is a package blank shown in FIGS. 1 and 3 whose one end is provided with a twofold sealing flap 8 and edges with twofold edge flaps 1*a* and 3*a*. As edge flap 1*a* is wider than edge flap 3*a*, adhesive zone 5 is partly visible. If desired, it is also possible to apply a glue seam on flap 3*a* but that is not necessary.

The obtained package blank is double-folded into V-shape along a crosswise bending line 6 which extends substantially in the middle of cardboard sheet 2. The length of edge flaps 1*a* and 3*a* exceeds the distance between the mouth and bottom of a package, said bending line 6 is in register with edge flaps 1*a* and 3*a*. By virtue of this, the bottom corner areas of a bag can be strengthened.

Figure 4:
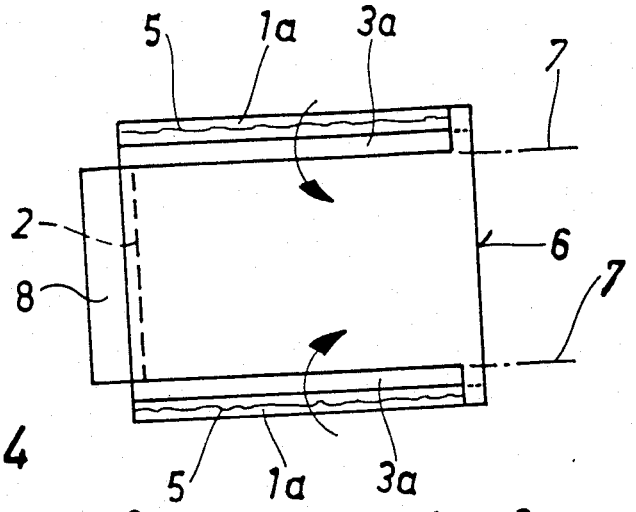
FIG. 4 shows a package blank of the invention after double-folding it along a central bending line.
Figure 5:
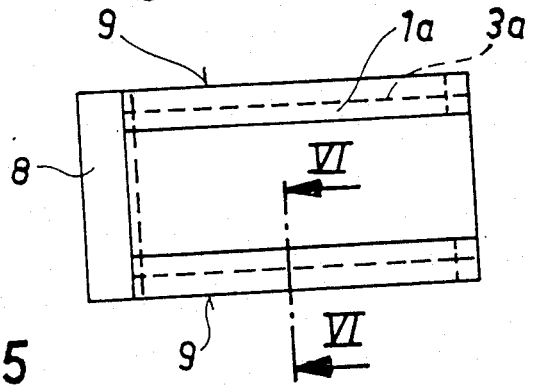
FIG. 5 show a ready package in a side view.

FIG. 4 shows the stage after a package blank has been double-folded around bending line 6. Thereafter, the face-to-face glued edge flaps 1*a* and 3*a* are bent around bending lines 7 extending along the side edges of reinforcement cardboard 2, said flaps sticking with adhesive 5 on the outer layer in the wide side area of bag 1.

Figure 6:
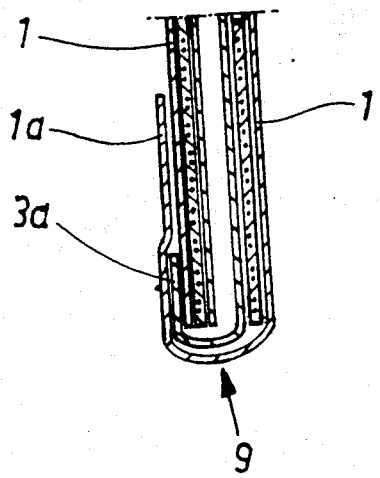
FIG. 6 is a section through the edge of a package line VI—VI in FIG. 5.
Figure 7:
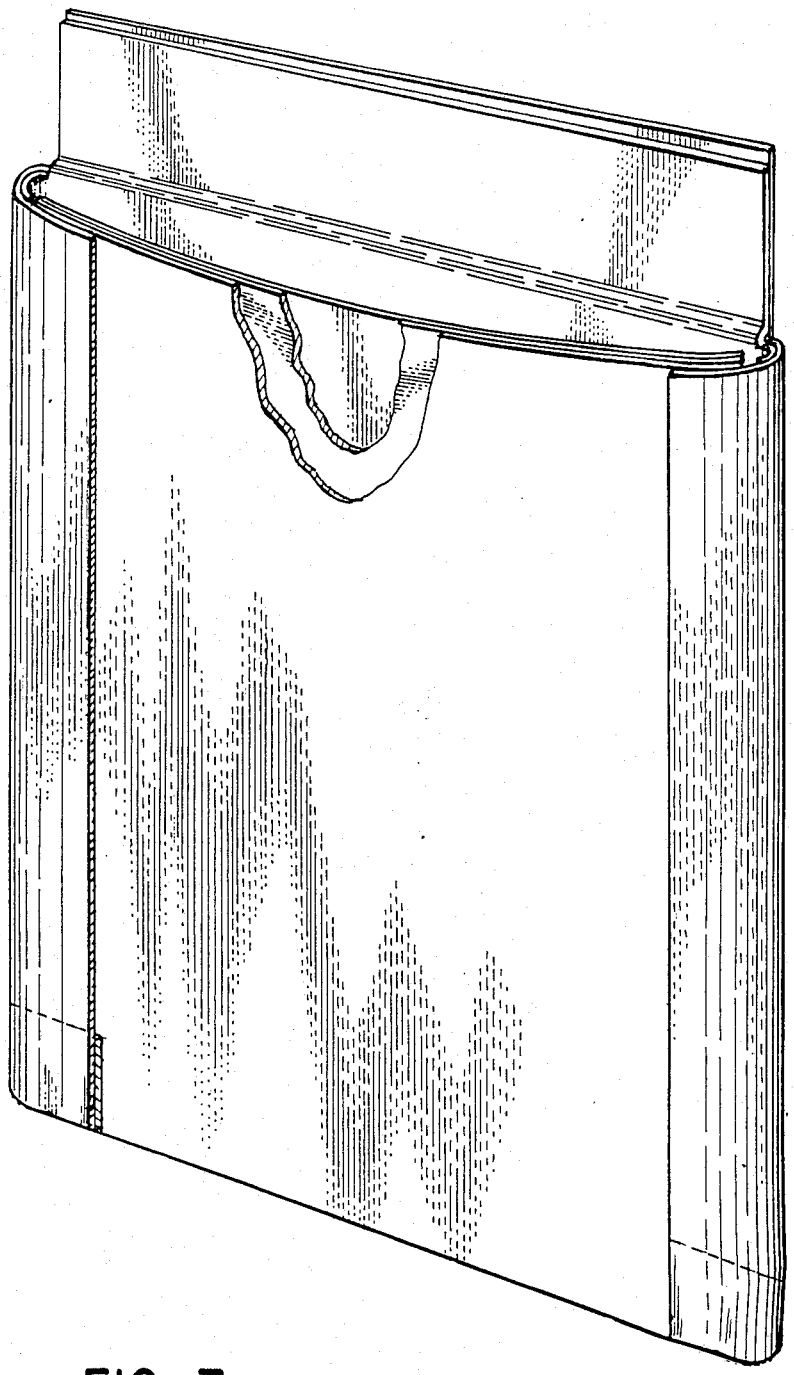
FIG. 7 is a perspective view of the assembled envelope.

As shown in the section of FIG. 6, the package side edge 9 is sealed with two-layer paper, i.e. with edge flaps 1*a* and 3*a* which are further glued face to face at the narrow side edge of a bag.

The length difference ΔL2 appearing in FIG. 2 between the cut-off point 2*c* of cardboard layer 2 and the cut-off points 1*c* and 3*c* of paper layers 1 and 3 has the effect that also the other edge of a bag mouth will be sealed, in other words, the layers are not apart from each other. The paper layers glued face to face at the other edge of a bag mouth extend sufficiently far to produce flap 8 for sealing the bag. This was effected by cutting the paper layers at side edge cut-outs 1*b* abd 3*b* in a manner that these side edge cut-outs 1*b* ábd 3*b* extend beyond the cut-off point 1*c*, 3*c* by the height of flap 8.

The fabrication method can be effected by means of a simple, fully automatic machine since no complicated functions are required. Cut-outs 1*b* and 3*b* can be simple made by rotating circular blades and crosswise cut-outs 1*c* and 3*c* can be made by a blade mounted on the surface of a rotating roll and extending axially of said roll. The application of adhesive zones 4 and 5 can be effected by means of ascendable and descendable sizing combs.

When bending into the V-shape, a crosswise bending tool strikes at bending line 6 and forwards a package blank double-folded in between bending rolls. Thereafter, bending of edge flaps 1*a* and 3*a* around line 7 is effected by using simple guides and finally the bag is fed through rolls that press the edge flap adhesives 5 on.

The same fabrication machine can be readily modified to suit the fabrication of packaging bags of various sizes. Thus, just the lengths of side edge cut-outs 1*b* abd 3*b* will change and so will their distances, i.e. the lengths of edge flaps 1*a* and 3*a*. Thus, the distances between cut-off points 1*c*, 2*c* and 3*c* will change accordingly.

I claim:

1. An envelope comprising inner and outer sheets of thin flexible material and an intermediate sheet of a reinforcing material having a resistance to bending greater than that of said inner and outer sheets, all of said sheets being elongated and having first and second portions on opposite sides of a laterally extending fold line substantially midway between the ends of said sheets; said first portion of each of said inner and outer sheets being wider than said first portion of said intermediate sheet to form sealing flaps, the ends of said inner and outer sheets of said first portion extending beyond said intermediate sheet to provide a double thickness closure flap; said inner and outer sheets being bonded to each other in the area of said sealing and closure flaps; the width of said second portion of all of said sheets being the same; said intermediate sheet being secured only to one of said inner and outer sheets and only to one of said first and second portions thereof; all of said sheets being folded about said fold line to provide a triple thickness bottom with said first and second portions extending generally parallel to each other as the back and front panels of the envelope, said sealing flaps being folded over against and bonded to said second portion of said outer sheet to provide double thickness side walls.

2. The package as described in claim 1 wherein the wider side edges of the first portion of the outer and inner sheets extend beyond the fold line and from corner reinforcements for the bottom end of the package at the fold line.

3. The package as described in claim 1 wherein the inner and outer sheets of the second portion are adhesively bonded together only at the free end of the second portion.

4. The package as described in claim 3 wherein the inner sheet of the first portion is bonded to the outer sheet of the first portion only at the end and along the side edges of the first portion.

5. The package as described in claim 1 wherein the width of said outer sheet first panel is greater than the width of said inner sheet first panel, whereby said outer sheet side sealing flaps completely cover said inner sheet side sealing flaps.

6. A package for an article comprising front and back panels arranged in parallel face to face relationship, each of said panels having an outer sheet and an inner sheet of flexible material and a reinforcing sheet sandwiched therebetween of a reinforcing material of greater resistance to bending and puncture than said inner and outer sheets, said panels being integral with each other at a bottom with all of said sheets extending as continuous webs from one panel to the other at said bottom to form a triple-thickness bottom; said reinforcing sheet being secured to only one of said inner and outer sheets and only to one of said front and back panels thereof; the ends of said inner and outer sheets of the back panel extending beyond the end of said reinforcing sheet and beyond the end of said front panel to form a closure flap, the sides of said inner and outer sheets of the back panel extending beyond the sides of the reinforcing panel to form double-thickness side sealing flaps folded over and bonded to the exterior face of the outer sheet of said front panel, said reinforcing sheet being bonded only to one end of said outer sheet; said inner sheet being bonded to said outer sheet at the ends of the panels adjacent the closure flap and at the side sealing flaps.

7. A package as described in claim 6 wherein said intermediate sheet is cardboard.

8. A package as described in claim 6 wherein said side sealing flaps extend beyond said bottom and are folded against and bonded to themselves as corner reinforcements.

* * * * *